US011872443B2

(12) United States Patent
Gatti et al.

(10) Patent No.: US 11,872,443 B2
(45) **Date of Patent: *Jan. 16, 2024**

(54) CLOSED-CIRCUIT SLIDING-BELT GYMNASTIC MACHINE AND MANUFACTURING METHOD THEREOF

(71) Applicant: Technogym S.p.A, Cesena (IT)

(72) Inventors: Davide Gatti, Cesena (IT); Alessandro Del Monaco, Cesena (IT); Edoardo Maria Carrai, Cesena (IT)

(73) Assignee: Technogym S.p.A, Cesena FC (IT)

( * ) Notice: Subject to any disclaimer, the term of this patent is extended or adjusted under 35 U.S.C. 154(b) by 0 days.

This patent is subject to a terminal disclaimer.

(21) Appl. No.: 17/859,012

(22) Filed: Jul. 7, 2022

(65) Prior Publication Data

US 2022/0339492 A1 Oct. 27, 2022

Related U.S. Application Data

(63) Continuation of application No. 17/005,379, filed on Aug. 28, 2020, now Pat. No. 11,420,091.

(30) Foreign Application Priority Data

Aug. 28, 2019 (IT) ..... 102019000015174

(51) Int. Cl.
*A63B 22/02* (2006.01)
*A63B 71/00* (2006.01)
(Continued)

(52) U.S. Cl.
CPC ..... *A63B 22/0235* (2013.01); *A63B 71/0054* (2013.01); *A63B 21/225* (2013.01); *A63B 22/0023* (2013.01); *A63B 22/02* (2013.01)

(58) Field of Classification Search
CPC ..... A63B 21/225; A63B 22/0235; A63B 22/0023; A63B 22/02; A63B 22/0242;
(Continued)

(56) References Cited

U.S. PATENT DOCUMENTS 7,722,507 B2 5/2010 Yoo
2006/0009333 A1 1/2006 Wang
(Continued)

FOREIGN PATENT DOCUMENTS

KR 10-2005-0087181 8/2005

OTHER PUBLICATIONS

European Search Report and the European Search Opinion dated Dec. 2, 2020 From the European Patent Office Re. Application No. 20192728.2. (8 Pages).
(Continued)

*Primary Examiner* — Megan Anderson

(57) ABSTRACT

A gymnastic machine comprising a frame having a base, wherein said base comprises a first and a second longitudinal member, a closed-circuit sliding-belt associated with said base, arranged between said first and said second longitudinal member, on which a user can execute a gymnastic exercise, and a transmission assembly having an electric motor, configured to move said closed-circuit sliding-belt, wherein said gymnastic machine. The electric motor is arranged below said closed-circuit sliding-belt.

10 Claims, 2 Drawing Sheets

(51) Int. Cl.
*A63B 21/22* (2006.01)
*A63B 22/00* (2006.01)

(58) Field of Classification Search
CPC ..... A63B 22/025; A63B 22/0257; A63B 71/0054
See application file for complete search history.

(56) References Cited

U.S. PATENT DOCUMENTS

| | | | | |
|---|---|---|---|---|
| 2007/0087908 | A1 | 4/2007 | Pan | |
| 2007/0225126 | A1 | 9/2007 | Yoo | |
| 2016/0089563 | A1 | 3/2016 | Dilli et al. | |
| 2018/0185699 | A1* | 7/2018 | Kueker ..... | A63B 22/0264 |
| 2021/0101049 | A1 | 4/2021 | Gatti et al. | |

OTHER PUBLICATIONS

Notice of Allowance dated Apr. 21, 2022 together with Interview Summary dated Apr. 12, 2022 from US Patent and Trademark Office Re. U.S. Appl. No. 17/005,379. (6 pages).
Official Action dated Feb. 8, 2022 from US Patent and Trademark Office Re. U.S. Appl. No. 17/005,379. (18 pages).
Rapporto di Ricerca e Opinione Scritta [Search Report and Written Opinion] dated Apr. 15, 2020 From the Ministero dello Sviluppo Economico, Direzione Generale Sviluppo Produttivo e Competitivita Uffico Italiano Brevetti e Marchi Re. Application No. IT201900015174. (7 Pages).

* cited by examiner

CLOSED-CIRCUIT SLIDING-BELT GYMNASTIC MACHINE AND MANUFACTURING METHOD THEREOF

RELATED APPLICATION

This application is a continuation of U.S. patent application Ser. No. 17/005,379 filed on Aug. 28, 2020, which claims the benefit of priority of Italian Patent Application No. 102019000015174 filed on Aug. 28, 2019, the contents of which are incorporated herein by reference in their entirety.

FIELD AND BACKGROUND OF THE INVENTION

The present invention relates to an improved closed-circuit sliding-belt gymnastic machine and manufacturing method thereof.

More specifically, the invention relates to a sliding-belt gymnastic machine, also known as treadmill, usually used for running, walking and the like workouts, which presents particular compactness features.

More specifically, the invention relates to a gymnastic machine of the above type, studied and realized in particular to allow the installation of an electric motor in an optimal way, whose solutions can be used for any machine, in particular gymnastic machines, in which it is necessary to keep compact the dimensions.

As is well known, there are currently sliding-belt gymnastic machines comprising electric motors, which rotate the walking belt.

This type of machines is traditionally installed in gyms. In recent times, however, these types of gymnastic machines are always more intended also to a domestic use, in which the savings in the management of space has become a central design aspect. In addition, the possibility of having a structurally small size layout, is also necessary, to enable the realization of appropriate design.

In these machines, an electric motor is required for actuating the sliding-belt. Generally, this component turns out to be rather bulky. The type of electric motors currently installed and used on sliding-belt type gymnastic machines of the prior art comprises kinematic chains for the transmission of motion, which entail large dimensions and wear of the parts.

SUMMARY OF THE INVENTION

The above also implies that the overall dimensions of the machines are proportionally high.

More specifically, for housing the electric motors that are currently installed in the above machines, the machines provide housings, with a relative lid, generally arranged at the front of the sliding-belt. This considerably increases the surface occupied by the gymnastic machine.

In light of the above, it is therefore an object of the present invention providing a sliding-belt gymnastic machine having smaller overall dimensions.

It is also an object of the present invention providing a sliding-belt gymnastic machine, which has a simpler and more compact mechanical structure and arrangement of components and parts, so that less maintenance may also be required.

These and other results are obtained according to the invention by means of an appropriate arrangement of the electric motor and of the motion transmission members with respect to the frame and the sliding-belt.

It is therefore specific object of the present invention a gymnastic machine comprising a frame having a base, wherein said base comprises a first and a second longitudinal member, a closed-circuit sliding-belt associated with said base, arranged between said first and said second longitudinal member, on which a user can execute a gymnastic exercise, and a transmission assembly having an electric motor, configured to move said sliding-belt, wherein said gymnastic machine is characterized in that said electric motor is arranged below said sliding-belt.

Always according to the invention, said machine may at least one dragging roller configured to drag said sliding-belt in a sliding direction, and said transmission assembly may comprise motion transfer members for transferring the motion of said electric motor to said dragging roller.

Still according to the invention, said dragging roller may comprise a coupling portion, said electric motor may comprise a pinion connected to the driving shaft, and said motion transfer members may comprise a driving belt, engaged with said coupling portion of said dragging roller and with said pinion of said electric motor.

Advantageously according to the invention, said motion transfer members may comprise at least one snub pulley of said driving belt, wherein said at least one snub pulley is rotatably coupled with said first longitudinal member.

Further according to the invention, said machine may comprise a flywheel, cinematically connected to said dragging roller.

Still according to the invention, said electric motor may have a rotation axis and said dragging roller may have a rotation axis said rotation axis of the electric motor, and said rotation axis of the dragging roller are parallel and said rotation axis of the electric motor is arranged below said rotation axis of the dragging roller.

Still according to the invention, said electric motor may have a rotation axis and said flywheel may have a rotation axis, said rotation axis of the electric motor and said rotation axis of the flywheel may be parallel and said rotation axis of the electric motor may be is arranged below said rotation axis of the flywheel.

Advantageously according to the invention, said machine may comprise a flywheel device comprising said flywheel, and a shaft, keyed on one first end with said flywheel, which has a tooting, obtained on the second free end, wherein said shaft is arranged in such a way that said tooting is aligned with said coupling portion of said dragging roller.

Furthermore, according to the invention, said first longitudinal member may have a housing and an opening obtained in correspondence of said housing, said flywheel is housed in said housing of said first longitudinal member, and said shaft may be arranged through said opening of said first longitudinal member.

Always according to the invention, said flywheel device may comprise a flange for fastening to said first longitudinal member.

Still according to the invention, said dragging roller may be arranged in the front part or in the rear part of said gymnastic machine.

Furthermore, according to the invention, said frame may comprise at least one horizontal support perpendicularly arranged, and coupled with said first and second side member, wherein said electric motor may be fastened to said at least one horizontal support.

It is also object of the present invention a manufacturing method of a gymnastic machine wherein said gymnastic machine comprises a frame having a base, wherein said base comprises a first and a second longitudinal member, a closed-circuit sliding-belt associated with said base, arranged between said first and second longitudinal member, on which a user can execute a gymnastic exercise, and a transmission assembly having an electric motor, configured for moving said sliding-belt, wherein said electric motor is arranged below of said sliding-belt.

BRIEF DESCRIPTION OF THE SEVERAL VIEWS OF THE DRAWINGS

The present invention will be now described, for illustrative but not limitative purposes, according to its preferred embodiments, with particular reference to the figures of the enclosed drawings, wherein.

In the various figures, similar parts will be indicated by the same reference numbers.

DESCRIPTION OF SPECIFIC EMBODIMENTS OF THE INVENTION

The gymnastic machine according to the present description provides a structure of the transmission members for the movement of at least one of the dragging rollers of the sliding-belt, so as to allow an optimal integration in the frame of the machine and in particular in the longitudinal members, which delimit and support the sliding-belt.

Figure 1:
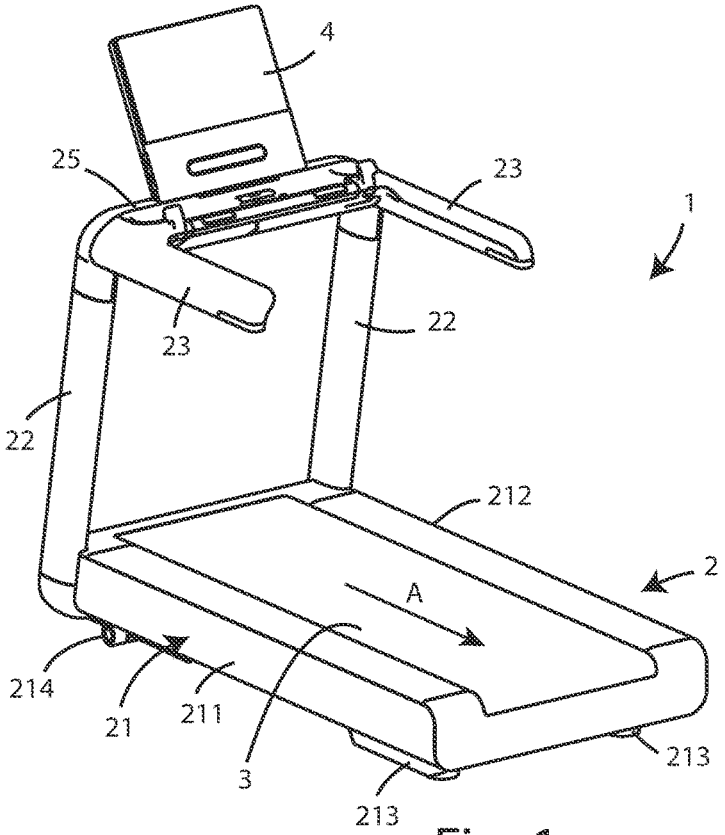
FIG. 1 shows a perspective view of an embodiment of a sliding-belt gymnastic machine according to the present description.
Figure 2:
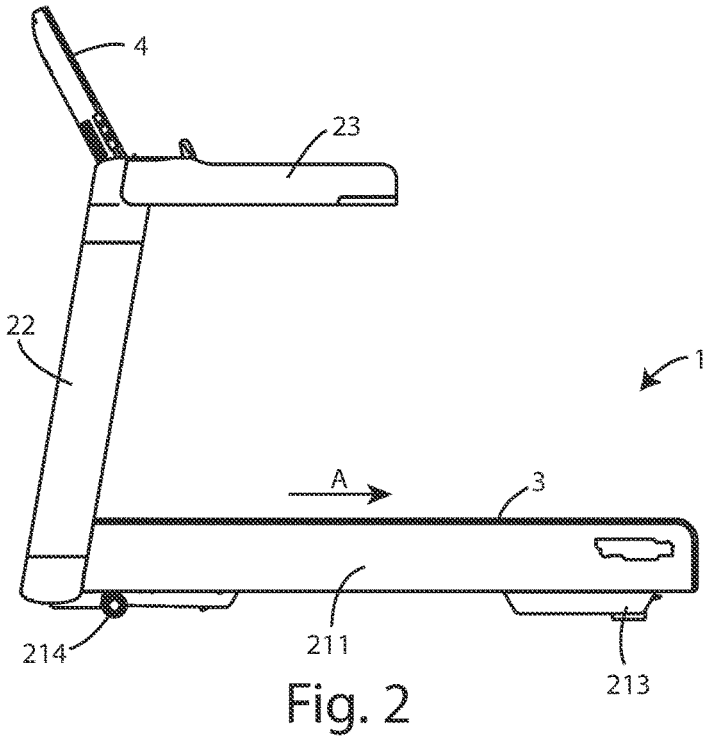
FIG. 2 shows a side view of the gymnastic machine according to FIG. 1.

With reference to FIGS. 1 and 2, a sliding-belt gymnastic machine according to the present description can be seen, indicated as a whole with the reference number 1.

The gymnastic machine 1 essentially comprises a frame 2, the sliding-belt 3, sliding with respect to said frame 2, a viewer or screen 4, on which the user can run or walk during gymnastic exercises, and a motion transmission assembly 5.

The frame 2 comprises a base 21 constituted by a first 211 and a second 212 lateral longitudinal member, arranged parallel to each other.

Said longitudinal members 211 and 212 can be profiles.

Below, said lateral members 211 and 212 comprise feet 213, on which the gymnastic machine 1 rests and wheels 214, connected to the base by means of a suitable kinematic mechanism for varying the inclination of the belt.

Said first lateral member 211 has in the rear portion a housing 211', in correspondence with which an opening 211" is obtained, whose function will be better described below.

Said frame 2 also comprises two supports 22, arranged substantially vertically, slightly inclined, each one of which comprises a grip or a support portion 23, on which the user can lean with his hands during the performance of the gymnastic exercises.

Said two supports 22 are connected by a crosspiece 25, which the viewer 4 is installed on.

Conventionally it identifies as the front of the gymnastic machine 1, the one in which said two supports 22, the crosspiece 25 and the viewer 4 are arranged. The rear, free, is of course opposite to said front part.

The sliding-belt 3, as mentioned, is in a closed circuit and runs between two dragging rollers parallel arranged, but perpendicular to said first 211 and second 212 lateral longitudinal member. In the present embodiment, the dragging rollers are rotatably arranged, one in correspondence with the front part of said gymnastic machine 1 and the other in correspondence with the rear part.

Figure 3:
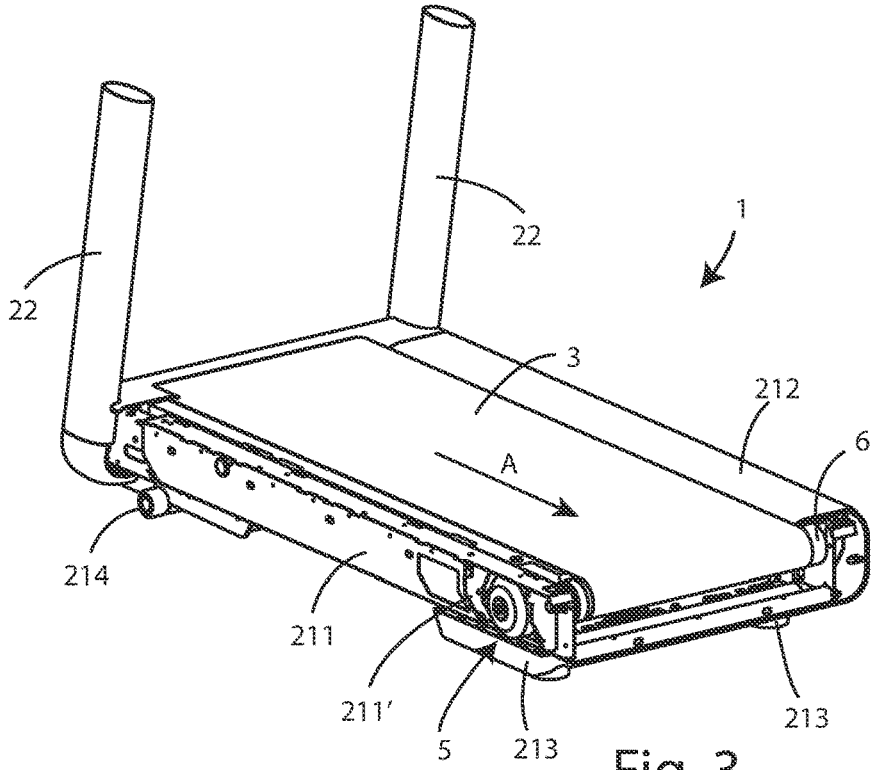
FIG. 3 shows a perspective view of a portion of the gymnastic machine according to FIG. 1.
Figure 4:
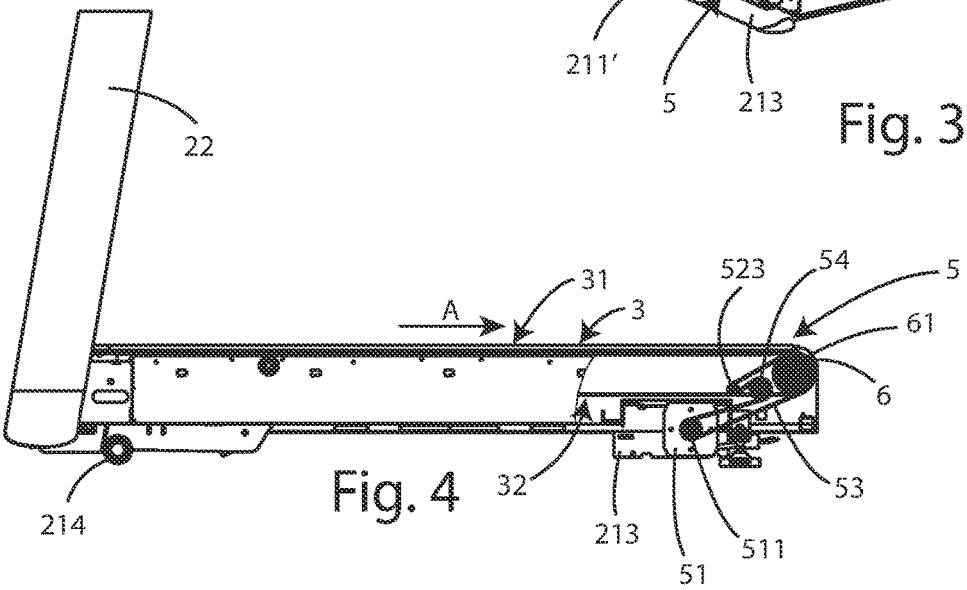
FIG. 4 shows a side view of a portion of the gymnastic machine.
Figure 5:
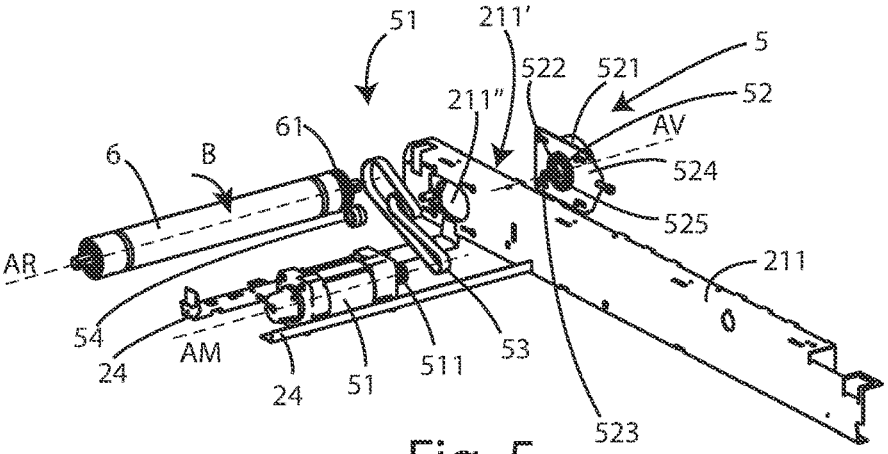
FIG. 5 shows the exploded view of a detail of the gymnastic machine according to FIG. 1.

With reference to FIGS. 3,4, and 5, only the dragging roller arranged in the rear part of said gymnastic machine 1, indicated with reference 6, can be seen.

As can be seen, said dragging roller 6 is rotatably coupled to an axis, which has its ends fixed on said first 211 and second 212 lateral member.

Furthermore, said dragging roller 6 also comprises a coupling portion 61, which in the present embodiment comprises a circumferential gearwheel, which in the case at issue is arranged close to said first lateral member 211, whose function will be better described in following.

The dragging rollers are rotatably coupled to the base 21, so as to slide the sliding-belt 3 along the direction indicated by the arrow A. In particular, as can be seen with reference to FIG. 5, the dragging roller 6 is rotated, as better explained below, along the direction of the arrow indicated by the letter B.

Always referring to FIG. 5, it is seen that the transmission assembly 5 comprises an electric motor 51, having an output motor shaft provided with a suitable pinion 511.

Said electric motor 51 can be of any type, and in particular it can be radial or axial and brushless, asynchronous, direct current, inductance type.

Said electric motor 51 is arranged below the sliding-belt 3, as can be seen in particular in FIG. 4. This allows to obtain a considerable saving in terms of room, and in particular to avoid installing the motor in a specific compartment generally arranged, in the machines according to the prior art, in the rear part or in the front part of the base of the frame, adjacent to the front end, or at the rear end of the base itself, with a consequent increase in the support surface of the gymnastic machine 1.

It should also be considered that the sliding-belt 3, being a closed-circuit, has a first portion 31, on the surface of which the user can walk when performing the exercise, and a second portion 32 which returns, arranged below said first portion 31. As can be seen in particular in FIG. 4, the motor 51 is arranged below the second portion 32 of the sliding-belt 3.

The base 21 of the frame 2 of said gymnastic machine 1 also comprises two horizontal supports 24, arranged perpendicularly, and coupled to said first 211 and second 212 lateral longitudinal member, to which the electric motor 51 can be fixed, by means of suitable fastening members such as screws, nuts, rivets and the like.

The transmission assembly 5 also includes a flywheel device 52, in its turn comprising a flywheel 521, whose function will be better explained in the following, a shaft 522, keyed at a first end with said flywheel 521, which comprises a gearwheel 523, obtained on the second free end.

The flywheel device 52 also comprises a flange 524 for coupling to said first lateral member 211. Said shaft 522 is rotatably coupled to said flange 524 by means of a bearing 525.

Said flywheel device 52 is arranged in the housing 211' of said first lateral member 211, so that the gearwheel 523 of the shaft 522 can pass through said opening 211", so as to protrude towards the inside of said first side member 211, in such a position that the circumferential gearwheel 61 on the dragging roller 6 is aligned with the gearwheel 523 of the shaft 522.

The transmission assembly 5 further comprises motion transmission members, which, particularly in the present embodiment, include a driving belt 53, for example of the Poly-V type, and a snub pulley 54, rotatably pivoted about said first lateral member 211.

The driving belt 53 is engaged with the pinion 511 of said motor 51, with the coupling portion 61 of said dragging roller 6 (or, in the embodiment at issue, with the circumferential gearwheel 61) with said flywheel 521, by means of the gearwheel 523 of the shaft 522, on which it is keyed, and with the snub pulley 54.

As can be seen in FIG. 4, said driving belt 53 is coupled to the snub pulley 54 with the non-toothed portion, while it is coupled to all the other elements of the transmission assembly 5 by the toothed portion.

The snub pulley 54 is positioned in such a way as to maximize the winding angle on the pinion 511 of the motor 51 and on the gearwheel 523 of the shaft 522. In this way, the transmission belt engages for a greater section, in particular with the gearwheel 523 of the shaft 522 keyed on the flywheel 521, and with the pinion 511 of the electric motor 51.

As can be seen, the motion transmission assembly 5 has a particularly compact arrangement of the components, which allows the motion to be transmitted from the electric motor 51, arranged entirely below the sliding-belt 3, to one of the dragging rollers 6.

In this case the electric motor 51 transmits the motion to the dragging roller installed at the rear of the gymnastic machine 1. However, in a similar way, said electric motor 51 may be arranged and installed so as to transmit the motion to the dragging roller installed in the front of the gymnastic machine 1.

The operation of the gymnastic machine 1 described above is as follows.

When the gymnastic machine 1 is activated by a user, generally acting on the viewer or display 4, which is generally of touch screen type, the electric motor 51 is activated and rotates the dragging roller 6 by means of the driving belt 53. At the same time, the flywheel 521 of said flywheel device 52 is also moved.

The function of the flywheel 521 is both attenuating any speed variations of the electric motor 51 and, when an exercise is terminated and the gymnastic machine 1 is switched off and the power supply of the electric motor 51 interrupted, allowing, by means of the inertia of the flywheel 521 of the flywheel device 52, a gradual slowing down of the sliding-belt 3, so as to prevent the user from falling if the sliding-belt 3 suddenly stops.

As can be seen, the electric motor 51 has an arrangement under the sliding-belt 3 and it is not arranged in the rear or the front part of the gymnastic machine 1, thus reducing the overall surface occupied by the same.

The transmission assembly 5 allows, owing to its arrangement and to the functional connection with the dragging roller 6, an optimal arrangement of components and thus an overall reduction of the surface occupied by the base 21.

Finally, as can be seen, while the electric motor 51 is advantageously arranged under the sliding-belt 3, the flywheel 521 is arranged above, again with respect to said electric motor 51, taking advantage of a space in any case occupied by the lateral member 211, without requiring additional space.

Thus, the axis arrangement of the flywheel 521 in an upper position with respect to the axis of the electric motor 51 carries a further advantage in terms of the encumbrance.

Indeed, if the flywheel were coupled directly to the motor (as usually happens in the machines according to the prior art), to obtain the required transmission ratio, the bulk of the diameter of the flywheel would have made it necessary to arrange the belt further raised, with apparent increase in the height of the sliding-belt, making it more difficult for the user to access the gymnastic machine.

More specifically, with reference to FIG. 5, the electric motor 51 has a rotation axis AM, said dragging roller 6 has a rotation axis AR, and the flywheel 521 has a rotation axis AV.

As can be seen, the axis AM of the electric motor 51 and the rotation axis AR of the dragging roller 6 are parallel. Furthermore, the axis of rotation AM of the electric motor 51 is arranged below the rotation axis AR of the dragging roller 6.

In addition, the rotation axis AM of the electric motor and the rotation axis AV of the flywheel 521 are parallel. Furthermore, the rotation axis AM of the electric motor 51 is arranged below the rotation axis AV of the flywheel 521.

An advantage of the present solution is that of allowing the realization of a very compact base of the frame of the gymnastic machine, with limited overall dimensions, without the need to include a front or rear hood for housing the motor/transmission/flywheel assembly.

It is also an advantage of the solution according to the invention the fact that the electric motor for the dragging of the sliding-belt is arranged below the belt, and only the snub pulley, the belt are arranged close the lateral longitudinal member of the frame of the gymnastic machine. In this way, the electric motor occupies a lowered position with respect to the dragging roller, which moves the belt.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

It is the intent of the Applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed:

1. A gymnastic machine comprising a frame having a base, wherein said base comprises a first and a second longitudinal member, a closed-circuit sliding-belt associated with said base, arranged between said first and said second longitudinal member, a transmission assembly having an electric motor, configured to move said closed-circuit sliding-belt, and at least one dragging roller configured to drag said closed-circuit sliding-belt in a sliding direction;

wherein said transmission assembly comprises motion transfer members for transferring the motion of said electric motor to said at least one dragging roller wherein said electric motor is arranged below said closed-circuit sliding-belt;

wherein the closed-circuit sliding-belt is configured to allow a user to execute a gymnastic exercise;

wherein said frame comprises at least one horizontal bar perpendicularly arranged, and coupled with said first and second side member, wherein said electric motor is fastened to said at least one horizontal bar;

wherein said at least one dragging roller comprises a coupling portion, said electric motor comprises a pinion connected to the driving shaft;

said motion transfer members comprise a driving belt, engaged with said coupling portion of said at least one dragging roller and with said pinion of said electric motor.

2. The gymnastic machine according to claim 1, further comprising a flywheel connected to said at least one dragging roller.

3. The gymnastic machine according to claim 2, wherein said electric motor has a rotation axis and said flywheel has a rotation axis, wherein said rotation axis of the electric motor and said rotation axis of the flywheel are parallel, and wherein said rotation axis of the electric motor is arranged below said rotation axis of the flywheel.

4. The gymnastic machine according to claim 2, further comprising a shaft keyed on one first end with said flywheel and mechanically connected to the second free end, wherein said shaft is aligned with said coupling portion of said at least one dragging roller.

5. The gymnastic machine according to claim 2, wherein said flywheel comprises a flange for fastening to said first longitudinal member.

6. The gymnastic machine according to claim 1, wherein said electric motor has a rotation axis and said at least one dragging roller has a rotation axis, wherein said rotation axis of the electric motor, and said rotation axis of the at least one dragging roller are parallel and wherein said rotation axis of the electric motor is arranged below said rotation axis of the at least one dragging roller.

7. The gymnastic machine according to claim 1, wherein said at least one dragging roller is arranged in the front part or in the rear part of said gymnastic machine.

8. A gymnastic machine comprising a frame having a base, wherein said base comprises a first and a second longitudinal member, a closed-circuit sliding-belt associated with said base, arranged between said first and said second longitudinal member, and a transmission assembly having an electric motor, configured to move said closed-circuit sliding-belt;

wherein said electric motor is arranged below said closed-circuit sliding-belt;

wherein the closed-circuit sliding-belt is configured to allow a user to execute a gymnastic exercise;

wherein said frame comprises at least one horizontal bar perpendicularly arranged, and coupled with said first and second side member, wherein said electric motor is fastened to said at least one horizontal bar;

wherein said motion transfer members comprise at least one snub pulley of said driving belt, wherein said at least one snub pulley is rotatably coupled with said first longitudinal member.

9. The gymnastic machine according to claim 8, comprising at least one dragging roller configured to drag said closed-circuit sliding-belt in a sliding direction, wherein said transmission assembly comprises motion transfer members for transferring the motion of said electric motor to said at least one dragging roller.

10. A gymnastic machine comprising a frame having a base, wherein said base comprises a first and a second longitudinal member, a closed-circuit sliding-belt associated with said base, arranged between said first and said second longitudinal member, a transmission assembly having an electric motor, configured to move said closed-circuit sliding-belt, at least one dragging roller configured to drag said closed-circuit sliding-belt in a sliding direction, and a flywheel connected to said at least one dragging roller;

wherein said electric motor is arranged below said closed-circuit sliding-belt;

wherein the closed-circuit sliding-belt is configured to allow a user to execute a gymnastic exercise;

wherein said frame comprises at least one horizontal bar perpendicularly arranged, and coupled with said first and second side member, wherein said electric motor is fastened to said at least one horizontal bar;

wherein said first longitudinal member has a housing and an opening obtained in correspondence of said housing;

wherein said flywheels is housed in said housing of said first longitudinal member;

wherein said shaft is arranged through said opening of said first longitudinal member.

* * * * *